US009548568B2

(12) United States Patent
Miyoshi

(10) Patent No.: US 9,548,568 B2
(45) Date of Patent: Jan. 17, 2017

(54) CONNECTOR WITH PLATE AND SHELL

(71) Applicant: HOSIDEN CORPORATION, Osaka (JP)

(72) Inventor: Toshiharu Miyoshi, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 14/853,262

(22) Filed: Sep. 14, 2015

(65) Prior Publication Data

US 2016/0099523 A1 Apr. 7, 2016

(30) Foreign Application Priority Data

Oct. 2, 2014 (JP) ..... 2014-203741

(51) Int. Cl.

| | |
|---|---|
| ***H01R 13/648*** | (2006.01) |
| ***H01R 13/6461*** | (2011.01) |
| ***H01R 13/428*** | (2006.01) |
| ***H01R 13/6585*** | (2011.01) |
| ***H01R 13/6596*** | (2011.01) |
| ***H01R 24/60*** | (2011.01) |
| *H01R 107/00* | (2006.01) |

(52) U.S. Cl.

CPC ..... *H01R 13/6461* (2013.01); *H01R 13/428* (2013.01); *H01R 13/6585* (2013.01); *H01R 13/6596* (2013.01); *H01R 24/60* (2013.01); *H01R 2107/00* (2013.01)

(58) Field of Classification Search

CPC ..... H01R 13/6587; H01R 23/668
USPC ..... 439/607.11, 607.09, 607.05
See application file for complete search history.

(56) References Cited

U.S. PATENT DOCUMENTS 6,074,225 A * 6/2000 Wu ..... H01R 23/6873 439/101
6,739,912 B2 * 5/2004 Korsunsky ..... H01R 13/6658 439/38

(Continued)

FOREIGN PATENT DOCUMENTS

| | | |
|---|---|---|
| EP | 2293393 | 3/2011 |
| JP | 2005019075 | 1/2005 |

OTHER PUBLICATIONS

Search Report issued by E.P.O. patent office in E.P.O. Patent Application No. 15186437.8, dated Feb. 26, 2016.

(Continued)

*Primary Examiner* — Phuong Dinh
(74) *Attorney, Agent, or Firm* — Greenblum & Bernstein, P.L.C.

(57) ABSTRACT

There are provided a first insulator substrate; a first contact comprising a plurality of contact pins arranged in an array on a top surface of the first insulator substrate; a second insulator substrate; a second contact comprising a plurality of contact pins arranged in an array on an undersurface of the second insulator substrate; a metal plate sandwiched between an undersurface of the first insulator substrate and a top surface of the second insulator substrate; and a metal shell accommodating the first and second insulator substrates, the first and second contacts and the metal plate; wherein the metal plate comprises a pair of protruding parts formed on both ends in an array direction of the contact pins, being oriented toward the outside; and the metal shell comprises a pair of windows to be engaged with the pair of protruding part.

4 Claims, 3 Drawing Sheets

(56) References Cited

U.S. PATENT DOCUMENTS

| | | | | |
|---|---|---|---|---|
| 8,968,031 | B2 * | 3/2015 | Simmel | H01R 13/659 439/108 |
| 9,231,356 | B1 * | 1/2016 | Ju | H01R 24/78 |
| 9,281,626 | B2 * | 3/2016 | Lin | H01R 13/6581 |
| 9,300,095 | B2 * | 3/2016 | Lin | H01R 24/60 |
| 2002/0028604 | A1 | 3/2002 | Lo et al. | |
| 2005/0208831 | A1 | 9/2005 | Lee | |
| 2007/0015416 | A1 * | 1/2007 | Gutierrez | H01R 24/64 439/676 |
| 2010/0221933 | A1 | 9/2010 | Wu | |
| 2013/0330976 | A1 * | 12/2013 | Simmel | H01R 13/659 439/660 |
| 2014/0024257 | A1 | 1/2014 | Castillo et al. | |
| 2016/0056583 | A1 * | 2/2016 | Chuang | H01R 13/6581 439/607.01 |
| 2016/0056593 | A1 * | 2/2016 | Miyoshi | H01R 24/60 439/676 |
| 2016/0111833 | A1 * | 4/2016 | McGrath | H01R 24/60 439/676 |

OTHER PUBLICATIONS

U.S. Appl. No. 14/794,149 to Toshiharu Miyoshi et al., filed Jul. 8, 2015.

* cited by examiner

CONNECTOR WITH PLATE AND SHELL

TECHNICAL FIELD

The present invention relates to a connector for high-speed signal transmission.

BACKGROUND ART

A conventional general connector is provided with a contact, a housing holding the contact, and a metal shell which accommodates the contact and housing. The housing of the conventional connector can be, for example, made of resin. In the conventional connector, it is common that a claw is provided on the housing side, and, on the metal shell side, a hole (groove) is provided on the internal wall of the metal shell so as to be engaged with the claw. When the housing is inserted into the metal shell, positioning is performed by the claw being engaged with the hole (groove) of the metal shell, and the housing and the contact are fixed in the metal shell (see, for example, Patent Literature 1 (Japanese Patent Application Laid Open No. 2005-19075)).

If the housing and the claw formed thereon are made of resin in the conventional connector, the strength of the claw is insufficient, and there may be a case where, at the time of being engaged with the metal shell, the claw is damaged by a stress applied to the claw or other external stresses.

SUMMARY OF THE INVENTION

Thus, an object of the present invention is to provide a connector in which a metal shell and a housing can be fixed without adding a new component and which is hardly damaged.

A connector of the present invention comprises: a contact comprising a plurality of contact pins arranged in an array; a metal plate reducing crosstalk of the contact; and a metal shell accommodating the contact and the metal plate; wherein the metal plate comprises a pair of protruding parts respectively formed toward the outside on both ends in an array direction of the contact pins; and the metal shell comprises a pair of windows to be engaged with the pair of protruding parts.

Effects of the Invention

A connector of the present invention is such that a metal shell and a housing can be fixed without adding a new component and that is hardly damaged.

BRIEF DESCRIPTION OF THE DRAWINGS

FIG. 1 is a perspective view showing a metal plate which a connector of a first embodiment of the present invention is provided with;

DETAILED DESCRIPTION

Figure 1:
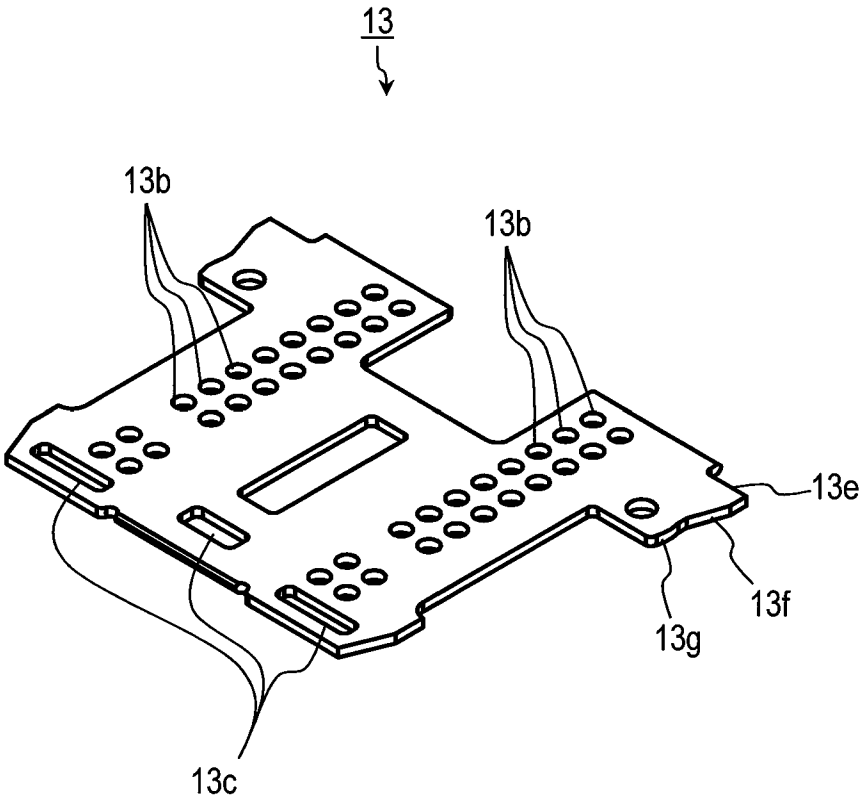

An embodiment of the present invention will be described below in detail. A component having the same function is given the same reference numeral, and duplication description is omitted.

First Embodiment

The shape of a metal plate of a connector of the present embodiment will be described below with reference to FIG. 1. FIG. 1 is a perspective view showing a metal plate 13 which a connector 10 of the present embodiment is provided with. The metal plate 13 is provided to reduce crosstalk between contacts to be described later. As shown in FIG. 1, there are formed a plurality of holes 13*b* with a size smaller than a circle having a diameter corresponding to the one-fourth length of a differential signal, in a predetermined area on the metal plate 13. The holes 13*b* may be in a circle, a square, or other shapes.

Further, long holes 13*c* are provided on one end side (on a connector-insertion-direction end side) of the metal plate 13. The long holes 13*c* are used to connect a first insulator substrate 11 and a second insulator substrate 12 to be described later or to fix the contacts on the insulator substrates, respectively.

On the metal plate 13, a pair of protruding parts 13*e* are respectively formed toward the outside on both ends in a direction of a contact pin array to be described later. A part of an end surface of each protruding part 13*e* forms an inclined plane 13*f*. The inclined planes 13*f* are formed such that the metal plate 13 gradually becomes wider toward the direction of pulling out the connector. In other words, the inclined planes 13*f* are formed such that the metal plate 13 gradually becomes narrower toward the direction of inserting the connector. Further, on the metal plate 13, a pair of projecting parts 13*g* are formed toward the outside and adjacent to the connector insertion sides of the protruding parts 13*e*, respectively. Each projecting part 13*g* may be formed by causing a part of an end surface of the metal plate 13 to be a curved surface protruding toward the outside as shown in FIG. 1. The projecting parts 13*g* are not limited thereto. The end surface of each projecting part 13*g* may be formed by a plurality of planes. For example, the projecting part 13*g* may be in a triangular plate shape having two end surfaces meeting at the top side of the projecting part 13*g*.

Figure 2:
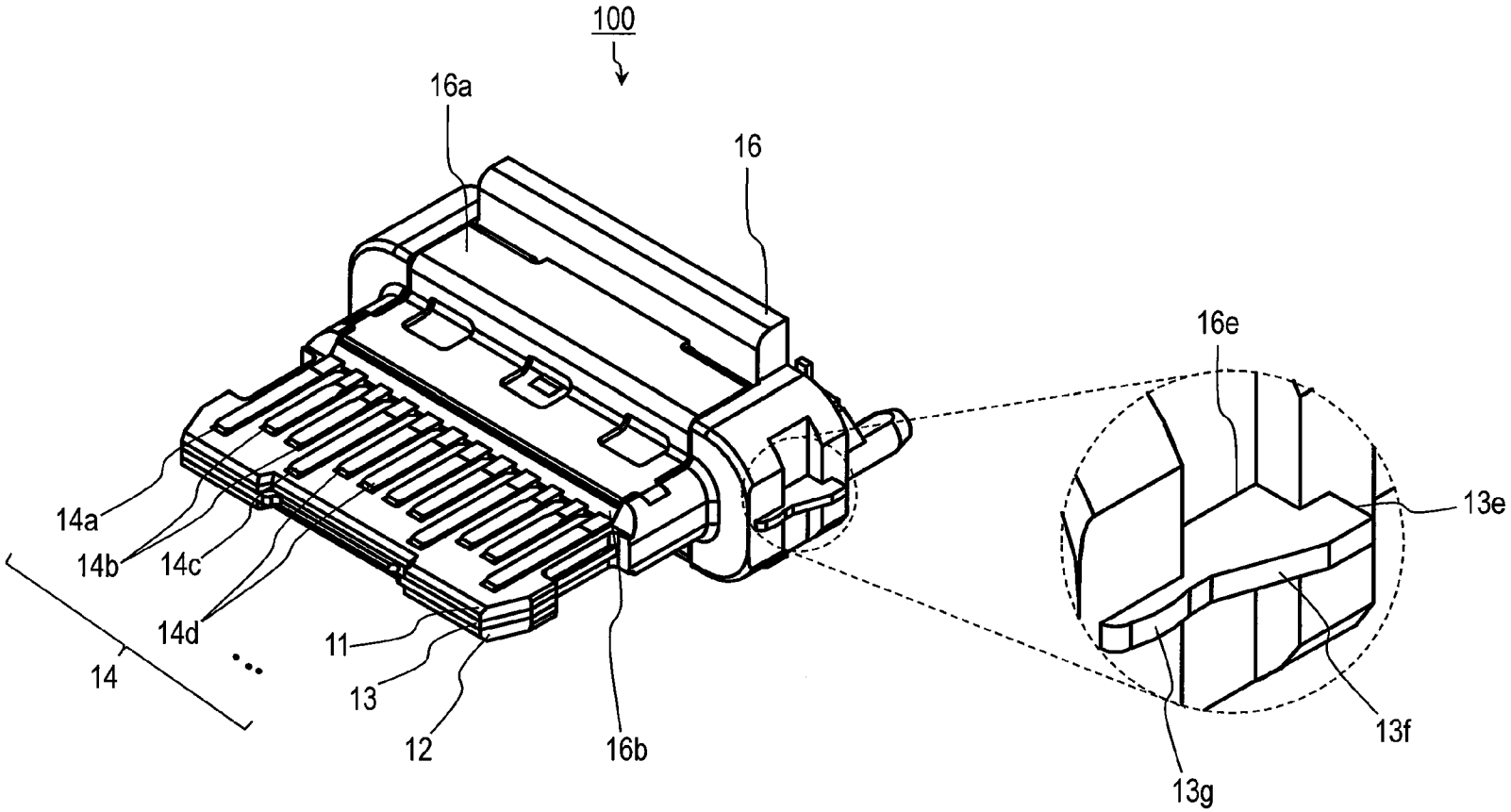
FIG. 2 is a perspective view showing a contact assembly which is an intermediate assembly of the connector of the first embodiment.

A contact assembly, which is an intermediate assembly of the connector 10 of the first embodiment of the present invention, will be described below with reference to FIG. 2. FIG. 2 is a perspective view showing a contact assembly 100 which is the intermediate assembly of the connector 10 of the present embodiment. The contact assembly 100 refers to an intermediate component configured by assembling the first and second insulator substrates, metal plate, first and second contacts and housing to be described later. As shown in FIG. 2, the contact assembly 100 comprises; a first insulator substrate 11, a first contact 14 comprising a plurality of contact pins comprising differential signal contact pins arranged in an array on the top surface of the first insulator substrate 11, a second insulator substrate 12, a second contact (not shown) comprising a plurality of contact pins comprising differential signal contact pins arranged in an array in the same direction as the array direction of the first contact 14 on the undersurface of the second insulator substrate 12, and the metal plate 13 sandwiched between the undersurface of the first insulator substrate 11 and the top surface of the second insulator substrate 12. In other words, the contact assembly 100 comprises a sandwich structure comprising the first contact 14, the first insulator substrate 11, the metal plate 13, the second insulator substrate 12 and the second contact (not shown) arranged in layers in that order with the first contact 14 at the top. One end side of each of the first insulator substrate 11, the second insulator substrate 12, the metal plate 13, the first contact 14 and the second contact is accommodated in a housing 16 which is in a cylindrical shape having almost oval sections, and the other end side is exposed from the housing 16. A removable top-surface cover 16*a* and internal cover 16*b* are fitted on the top surface of the housing 16. For example, the housing 16 and the internal cover 16*b* may be made of resin, and the top-surface cover 16*a* may be made of metal.

As shown in FIG. 2, the first contact 14 is provided with a first ground pin 14*a* which is a contact pin for ground; (two) first differential signal pins 14*b* which are contact pins for differential signals; a first power source pin 14*c* which is a contact pin for a power source; (four) first low-speed signal pins 14*d* which are contact pins for low-speed signals; a first power source pin 14*c*; two first differential signal pins 14*b*; and a first ground pin 14*a* which is a contact pin on the right end in that order from the left end. Thus, the first contact 14 is symmetrically configured. The second contact has a similar structure. Specifically, the second contact is provided with a second ground pin which is a contact pin for ground; (two) second differential signal pins which are contact pins for differential signals; a second power source pin which is a contact pin for a power source; (four) second low-speed signal pins which are contact pins for low-speed signals; a second power source pin; two second differential signal pins; and a second ground pin which is a contact pin on the left end in that order from the right end. Thus, similarly to the first contact 14, the second contact is symmetrically configured. The contact pins of the first contact 14 and the contact pin of the second contact are arrayed in the same order positions so that each contact pin of the first contact 14 and a corresponding contact pin of the second contact face each other.

A pair of slits 16*e* are provided on both contact-array-direction ends of the housing 16, respectively. Each slit 16*e* is a hole provided to insert the protruding part 13*e* and projecting part 13*g* described above. The protruding part 13*e* and projecting part 13*g* described above are exposed to the outside of the housing 16 via the slit 16*e*.

Although the connector 10 of the present embodiment is provided with a total of two contact lines, the first contact and the second contact, the connector 10 is not limited thereto and may be provided with one contact line.

Figure 3:
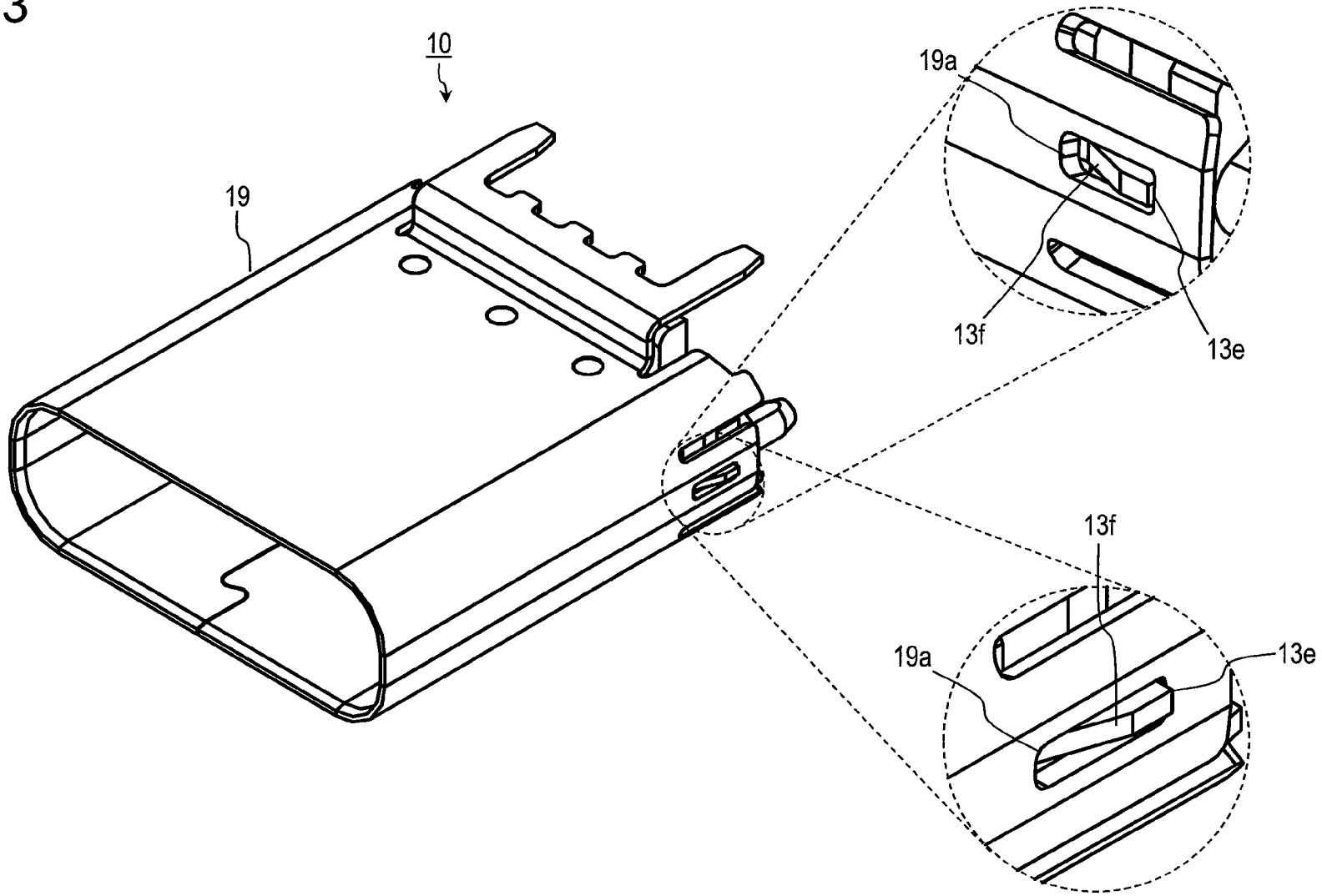
FIG. 3 is a perspective view showing a state in which the contact assembly of the first embodiment is attached to a metal shell.

Next, a state in which the contact assembly 100 is attached to a metal shell 19 will be described with reference to FIG. 3. FIG. 3 is a perspective view showing the state in which the contact assembly 100 of the present embodiment is attached to the metal shell 19.

A pair of windows 19*a* are provided on both contact-array-direction ends of the metal shell 19, respectively. Although the windows 19*a* are in an oval shape as shown in FIG. 3, the shape of the windows 19*a* is not limited thereto. For example, the windows 19*a* may be in a rectangular shape. By the pair of windows 19*a* being engaged with the pair of the protruding parts 13*e*, the contact assembly 100 and the metal shell 19 are positioned and fixed. The contact assembly 100 is inserted from the rear end (a connector-pulling-out-direction end) of the metal shell 19 toward the connector-insertion-direction. In this case, a maximum length of the above-described metal plate 13 in a width-direction (a contact array direction) is defined such that it is slightly larger than the width-direction (the contact array direction) inside diameter of the metal shell 19. More specifically, the width-direction maximum length of the metal plate 13 is defined such that it is larger than the width-direction inside diameter of the metal shell 19 by a length corresponding to the length of the projection of the pair of protruding parts 13*e* toward the outside. By the pair of the protruding parts 13*e* being formed on the metal plate 13 as described above, inward stress is gradually applied to the metal plate 13 along the inclined planes 13*f* described above when the contact assembly 100 is inserted into the metal shell 19. Thereby, in the course of inserting the contact assembly 100, the metal plate 13 is elastically deformed slightly, and the width-direction maximum length is reduced. When the whole lengths of the pair of the protruding parts 13*e* are within the respective windows 19*a*, the protruding parts 13*e* are inserted in the windows 19*a*. The stress applied to the metal plate 13 is released, and the metal plate 13 returns to the original shape. Thereby, the paired protruding parts 13*e* are fitted in the windows 19*a*, respectively, and fixed. As described above, the contact assembly 100 is positioned and fixed at a predetermined position in the metal shell 19.

The width-direction length of the metal plate 13 comprising the apexes of the projecting parts 13*g* is defined such that it is slightly larger than the width-direction inside diameter of the metal shell 19. Thereby, when the contact assembly 100 is inserted into the metal shell 19, the apexes of the projecting parts 13*g* are brought into contact with the inside surface of the metal shell 19. The apexes of the projecting parts 13*g* and the inside surface of the metal shell 19 are brought into contact with each other with such a predetermined pressure that the apexes and the inside surface are electrically connected (brought into conduction). In the present embodiment, the length of the projections of the projecting parts 13*g* at the apexes is smaller than the length of the projections of the protruding parts 13*e* at the apexes.

Thus, according to the connector of the present embodiment, by the protruding parts 13*e*, which are parts to be engaged with the metal shell 19 being formed with metal, the mechanical strength of the protruding parts 13*e* can be increased in comparison with the case of forming the protruding parts 13*e* with resin, and a structure is realized in which the contact assembly 100 is stably fixed at a predetermined position in the metal shell 19. Further, by utilizing a part of the metal plate 13 required for reduction of crosstalk between the contacts to form the protruding parts 13*e*, it is not necessary to prepare a new component to obtain the effect of the present embodiment, and the material cost and the assembly cost do not increase. It is common to fix a metal plate for reduction of crosstalk with solder directly to an insulator substrate on which a connector is to be implemented, to realize electrical connection. However, there is a problem that, if there is not a space for soldering on the insulator substrate, the metal plate is in a state of electrically floating in the air. In the connector 10 of the present embodiment, by bringing the projecting parts 13*g* formed on the metal plate 13 into contact with the metal shell 19 with a predetermined pressure, the metal plate 13 and the metal shell 19 are electrically connected. Therefore, by fixing the metal shell 19 with solder on a connector implementation substrate, the metal plate 13 and the connector implementation substrate can be electrically connected via the metal shell 19 even if there is not a space for fixing the metal plate 13 with solder directly on the insulator substrate.

What is claimed is:

1. A connector comprising:

a contact comprising a plurality of contact pins arranged in an array;

a metal plate reducing crosstalk of the contact; and a metal shell accommodating the contact and the metal plate; wherein the metal plate comprises a pair of protruding parts respectively formed toward the outside on both ends in an array direction of the contact pins; and the metal shell comprises a pair of windows which have a closed shape to be engaged with the pair of protruding parts.

2. A connector comprising:

a first insulator substrate;

a first contact comprising a plurality of contact pins arranged in an array on a top surface of the first insulator substrate;

a second insulator substrate;

a metal plate sandwiched between an undersurface of the first insulator substrate and a top surface of the second insulator substrate; and a metal shell accommodating the first and second insulator substrates, the first contact and the metal plate; wherein the metal plate comprises a pair of protruding parts respectively formed toward the outside on both ends in an array direction of the contact pins; and the metal shell comprises a pair of windows which have a closed shape to be engaged with the pair of protruding parts.

3. The connector according to claim 1, wherein the metal plate comprises a pair of projecting parts formed toward the outside and adjacent to connector insertion sides of the protruding parts, the pair of projecting parts being brought into contact with an inside surface of the metal shell at the time of being accommodated in the metal shell.

4. The connector according to claim 2, wherein the metal plate comprises a pair of projecting parts formed toward the outside and adjacent to connector insertion sides of the protruding parts, the pair of projecting parts being brought into contact with an inside surface of the metal shell at the time of being accommodated in the metal shell.

* * * * *